US006955207B2

(12) United States Patent
Minder

(10) Patent No.: US 6,955,207 B2
(45) Date of Patent: Oct. 18, 2005

(54) FRICTION DEVICE FOR ROLL-UP CURTAINS AND THE LIKE

(76) Inventor: Carl Emil Felix Minder, Via Disciplini 9, Bologna (IT) I-20123

( * ) Notice: Subject to any disclaimer, the term of this patent is extended or adjusted under 35 U.S.C. 154(b) by 0 days.

(21) Appl. No.: 10/480,553

(22) PCT Filed: Jun. 20, 2002

(86) PCT No.: PCT/IB02/02284

§ 371 (c)(1),
(2), (4) Date: Dec. 12, 2003

(87) PCT Pub. No.: WO03/001018

PCT Pub. Date: Jan. 3, 2003

(65) Prior Publication Data

US 2004/0154759 A1 Aug. 12, 2004

(30) Foreign Application Priority Data

Jun. 21, 2001 (IT) ..... BO01A0396

(51) Int. Cl.[7] ..... E06B 9/80
(52) U.S. Cl. ..... 160/298; 160/296; 160/293.1
(58) Field of Search ..... 160/298, 299, 160/296, 307, 318, 293.1; E06B 9/84; 188/268

(56) References Cited

U.S. PATENT DOCUMENTS

| | | | | |
|---|---|---|---|---|
| 146,659 | A * | 1/1874 | Davies | 160/298 |
| 700,951 | A * | 5/1902 | Leach | 160/292 |
| 5,437,324 | A * | 8/1995 | Sternquist | 160/299 |
| 6,123,140 | A * | 9/2000 | Bergamaschi | 160/316 |

* cited by examiner

*Primary Examiner*—Blair M. Johnson
(74) *Attorney, Agent, or Firm*—William J. Sapone; Coleman Sudol Sapone PC

(57) ABSTRACT

A friction device (10), applied to roll-up curtains and the like, includes a tubular roller (1), on which the curtain (2) rolls up, and which is rotatably carried on a horizontal axis. The friction device (10) includes a threaded shaft (9), situated axially inside the roller (1) and connected to the roller (1) by interposition of an angular speed reducer group (4). A body (11), mounted sliding axially inside the roller (1), is screw-coupled with the threaded shaft (9), so as to translate axially due to the shaft (9) rotation during unrolling or rolling up of the curtain (2) on the roller (1). One or more elastic members (12), subjected to pressure or counter-thrust, are compressed, on opposite ends, between abutment means (13) and a surface of the body (11), to determine a friction effect, which varies as a function of the rotation direction of the roller (1).

15 Claims, 5 Drawing Sheets

A
1
2
3
4
5
6
7
8
9
10
11
12
13
20
K
IV
VI

FRICTION DEVICE FOR ROLL-UP CURTAINS AND THE LIKE

FIELD OF THE INVENTION

The present invention relates to the technical field concerning roll-up curtains to be applied to windows and the like, in order to shade, protect or decorate.

BACKGROUND OF THE INVENTION

The roll-up curtains are usually rolled up on a roller, which is rotatably carried on a horizontal axis inside a suitable casing situated at top of the window.

The axial rotation of the roller determines rolling and unrolling of the curtain.

According to a known solution, the roll-up curtains are operated manually during both rolling and unrolling.

For this purpose, the head of the roller has a pulley featuring a groove, which engages with an operating chain.

One of the drawbacks of this type of roll-up curtains is the risk of falling during unrolling, i.e. a too quick descent of the curtain can occur due to its weight.

It is to be particularly noted that the falling speed of the curtain increases rapidly during unrolling.

Obviously, this drawback is felt stronger in the special case of relatively heavy curtains.

According to another solution, the roll-up curtains are equipped with a safety device with elastic means situated inside the roller and fastened thereto to facilitate the curtain rolling up.

The curtain unrolling rotation, carried out by acting directly thereon, determines torsion of the elastic means, so that the consequent elastic reaction can be used for rolling up again the curtain.

The elastic means are fastened, at one end, to the roller and at the other end, to a stationary support structure, so that they are stressed in accordance with the curtain unrolling.

To avoid undulations, possible in particular conditions, of the elastic means, these elastic means are fastened at one end to a movable element, which moves axially inside the roller, and are driven into rotation therealong.

For instance, the European Patent EP 0900314 describes improved elastic means, which return a gradual elastic reaction during the curtain rolling up.

The improved elastic means include a plurality of helical springs aimed at rolling the curtain up on a respective roller.

The coil springs are fastened to a common support, keyed to the roller, and to respective support and constraint elements, geometrically fastened to the above roller.

The above described support devices fulfill also the additional task of contrasting the curtain descent, but obviously, they themselves cannot solve the drawback of a curtain possible fall during unrolling.

SUMMARY OF THE INVENTION

The object of the present invention is to propose a friction device which avoids possible fall of the curtain during unrolling, independently from the design and dimensions of the curtain.

Another object of the present invention is to propose a friction device capable of braking the curtain fall during its unrolling.

A further object of the present invention is to propose a friction device, which is very functional and simple to manufacture, as well as to use, and which is versatile and can be used with different types of roll-up curtains.

A still further object of the present invention is to propose a device which is associated to a curtain operated by a chain and which is not damaged if the curtain is operated directly manually.

A yet further object of the present invention is to propose a universal device, i.e. a device which can be connected, during the installation or in any subsequent moment, to any end of the curtain, so as to be connected to the operating chain situated either on the right or on the left of the latter.

A still further object of the present invention is to propose a device which not only achieves the previous objects, but is also cheap and includes components such as to render the assembly easy.

A yet further object of the present invention is to propose a device which can be assembled in one piece, so that it can easily be mounted in a related curtain.

A still further object of the present invention is to propose a device which, when associated to the curtain equipped with support elastic means, balances in a simple way the operation of the curtain during the unrolling and rolling up thereof.

The above mentioned objects are obtained in accordance with the contents of the claims, by means of a friction device for roll-up curtains and the like, including a tubular roller, on which the curtain rolls up, and which is rotatably carried on a horizontal axis, characterized in that it includes a threaded shaft, situated axially inside said roller and connected to the roller by interposition of an angular speed reducer group; a body mounted sliding axially inside said roller and screw-coupled with said threaded shaft, so as to translate axially due to the shaft rotation during unrolling or rolling up of said curtain on said roller; at least one elastic member which is tightened, on the opposite ends, between the abutment means and a surface of said body, to determine, due to the pressure or counter-thrust to which the elastic member is subjected, a friction effect, which varies as a function of the rotation direction of said roller.

BRIEF DESCRIPTION OF THE DRAWINGS

The characteristic features of the present invention will be pointed out in the following description of a preferred, but not sole embodiment, with reference to the enclosed drawings, in which.

BEST MODES OF CARRYING OUT THE INVENTION

Figures 1, 2, 3, 4:
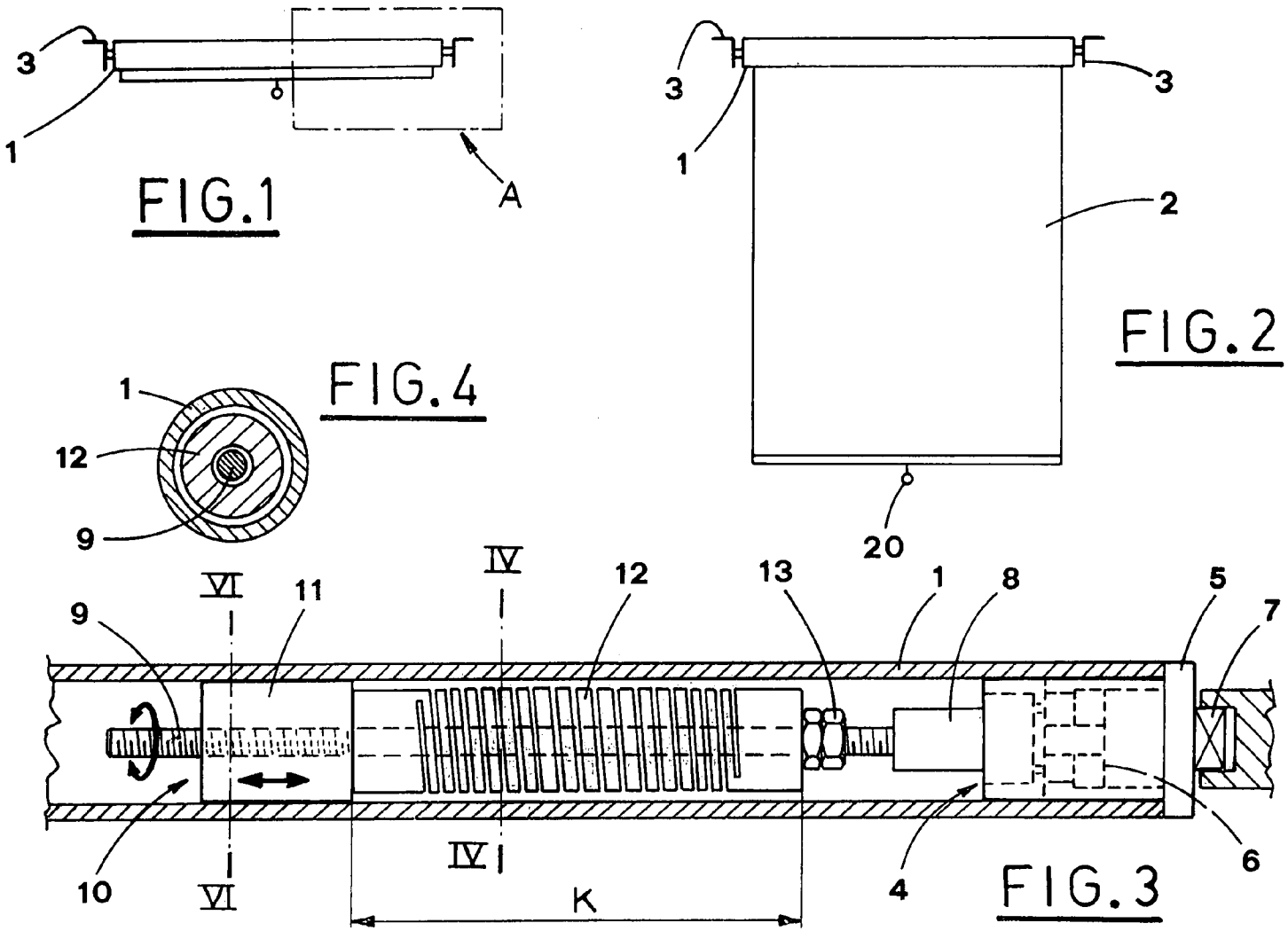
FIG. 1 is a schematic view of a roll-up curtain in rolling up configuration.
FIG. 2 is a schematic view of the roll-up curtain in unrolling configuration.
FIG. 3 is a longitudinal section view of a head of the roller of the roll-up curtain, corresponding to the portion A of FIG. 1.
FIG. 4 is a cross-section view of the roller taken along the plane IV—IV of FIG. 3.

With reference to the above figures, the reference numeral 1 indicates the tubular roller, on which the curtain 2 rolls up.

The roller 1 is rotatably supported on a horizontal axis, by respective supports 3, which are integral with the stationary structure.

One end of the roller 1 abuts against a speed reducer connection group indicated as a whole with 4.

More in detail, the roller 1 couples in a prismatic way with a cup-like element 5, which consequently rotates together with the roller 1.

A head 6, introduced into the cavity formed by the cup-like element 5, is rigidly fastened to the support 3 of the stationary structure by coupling with a prismatic appendix 7 of the element 5.

As described in detail in the European Patent EP 0900314, the head 6 features an axial toothed protrusion, which meshes with a plurality of planetary toothed wheels carried by a planetary wheel carrying member 8 and engages with a circumference toothing made on the inner surface of the cup-like element 5, so as to form a planetary gear.

The planetary wheel carrying member 8 is rigidly fastened to a threaded shaft 9, extending axially inside the roller 1.

The shaft 9 is a part of a friction device, indicated as a whole with 10, inserted into the roller 1.

The friction device 10 includes a cylindrical body 11, which features axially a threaded hole aimed at coupling with the shaft 9.

The cylindrical body 11 rotates together with the roller 1, but it can translate axially with respect thereto.

One end of an elastic member 12 acts on a surface of the cylindrical body 11, whereas the opposite end of the elastic member 12 abuts against a nut 13 screwed onto the shaft 9.

By acting on the nut 13 it is possible to adjust the preloading of the elastic member 12, consequently the elastic member 12 is subjected to pressure and counter-thrust.

According to the embodiment shown in FIGS. 3 and 4, the elastic member 12 preferably includes a helical leaf spring, obtained e.g. beginning from a cylindrical tubular element of e.g. steel or other material fulfilling the same elastic function, in which a helical incision is made by mechanical cutting.

The spring obtained according to this embodiment compresses without deforming which assures a long duration. This type of helical leaf spring is particularly suitable for curtains which are heavy and/or of considerable dimensions.

Figure 3A:
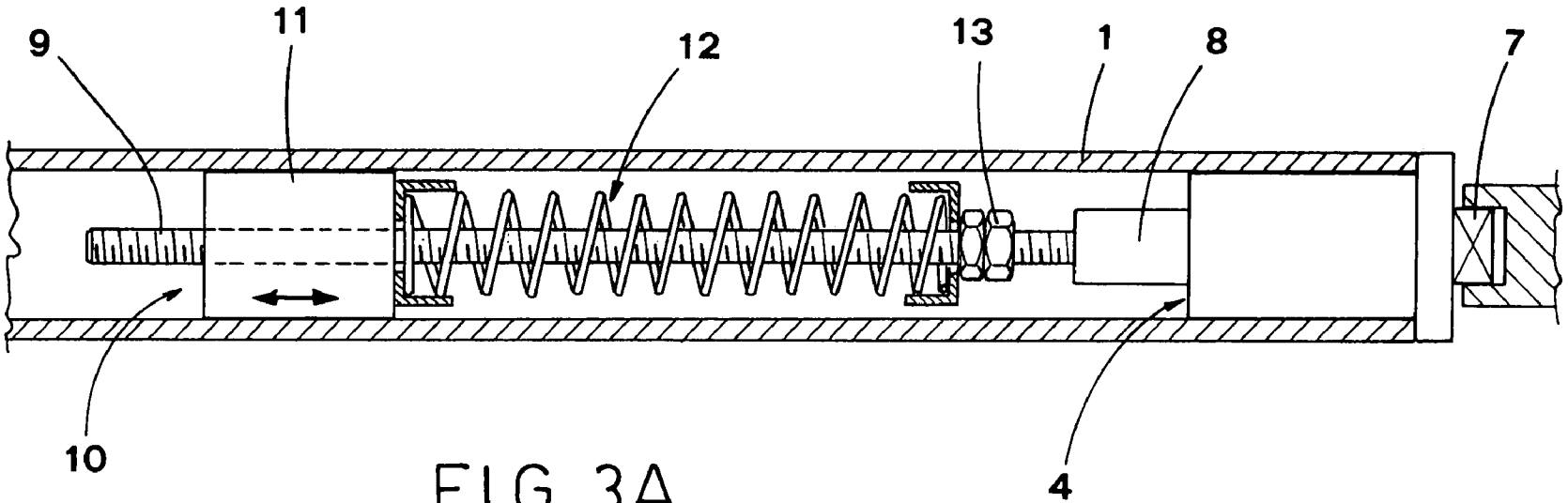
FIG. 3A shows a variant of what is shown in FIG. 3.

As an alternative to the above described type of spring, it is possible to use a normal commercial spring, e.g. a helical spring (see FIG. 3A), particularly indicated for currently used curtains: the material used is, e.g. steel kind or other material fulfilling the same elastic function.

The working of the device will be described in the following.

When the curtain 2 is pulled, by acting directly thereon by e.g. a lower ring 20, the roller 1 is made to rotate on the supports 3.

The roller 1 drives the shaft 9, inserted axially therein, into rotation with an angular travels suitably reduced by the reducer group 4 which acts as an intermediary.

In other words, the shaft 9 rotates with a relatively lower extension with respect to the roller 1.

Figure 6:
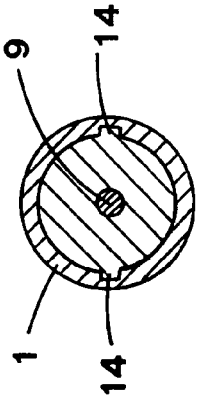
FIG. 6 is a cross-section view taken along the plane VI—VI of FIG. 3.

The relative rotation of the shaft 9 with respect to the roller 1 determines an axial translation of the cylinder 11 of the friction group 10, whose rotation with respect to the same roller 1 is prevented by suitable prismatic coupling means, e.g. a pair of opposite teeth 14, guided in corresponding inner grooves of the roller 1, as seen in FIG. 6.

The axial translation of the cylinder 11 causes a progressive change of the length K of the spring 12, which is stationary at the abutment on the nut 13, and consequently, a progressive change of the compression of the spring 12.

Accordingly, the initial compression of the spring can be suitably adjusted, by registering the position of the nut 13.

Obviously, the bigger or smaller compression of the spring 12 changes the elastic thrust action exerted on the cylinder 11 and consequently, avoids the fall of the curtain during the unrolling step.

Practically, during the curtain 2 unrolling, the compression of the spring 12 is progressively increased and consequently, also the friction effect is increased.

On the contrary, during the curtain 2 rolling up, the spring 12 is progressively released and consequently, the friction effect is reduced.

This allows especially to contrast in a suitable way the curtain 2 unrolling, with an increasing braking effect due to the friction, so as to prevent the curtain 2 fall during the unrolling step.

On the contrary, the braking effect is reduced progressively during the curtain 2 rolling up.

As a consequence, the rapid fall of the curtain is advantageously prevented, even if the curtain is relatively heavy.

Figure 5:
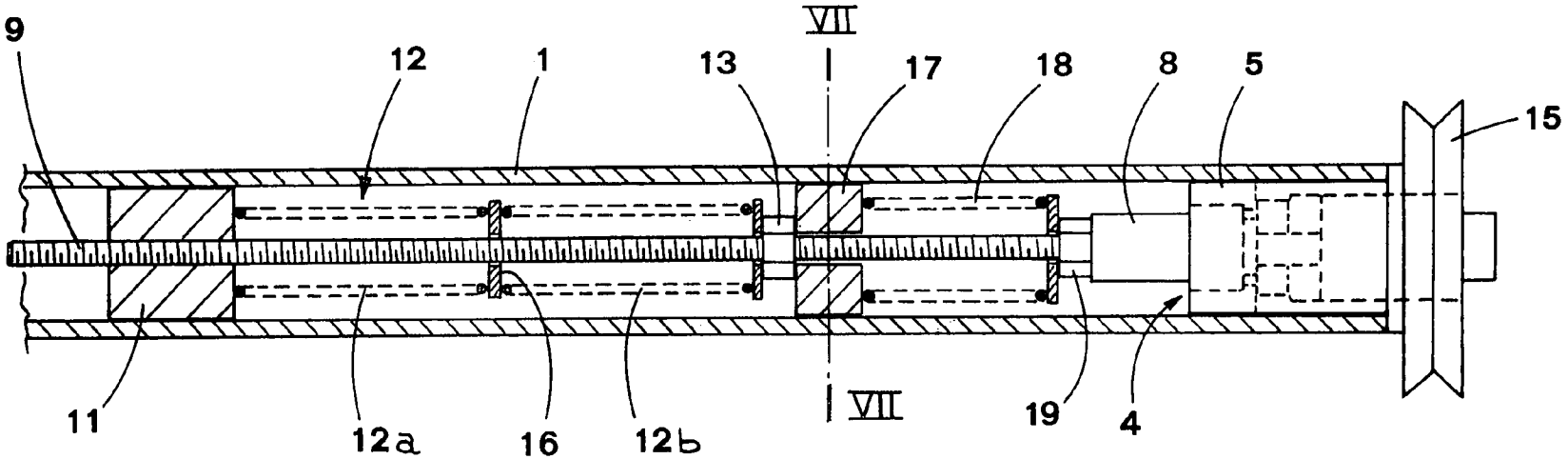
FIG. 5 is a longitudinal section view of a head of the roller according to a different embodiment.

FIG. 5 shows a different embodiment of the friction device, used in particular with roll-up curtains operated by a chain or other similar means.

The chain engages with a shaped groove of a pulley 15 made on the outer edge of the cup-like element 5 of the reducer group 4.

According to this solution, the cylinder 11 is acted upon by an elastic member 12 formed in the shown example by a pair of helical springs 12*a* and 12*b* which push on an intermediate disc 16.

The elastic member 12 abuts against the adjustment nut 13 screwed on the shaft 9, against which an additional cylindrical body 17 goes in abutment, stressed by a relative elastic member 18, which on its turn goes in abutment against a further adjustment nut 19.

Figure 7:
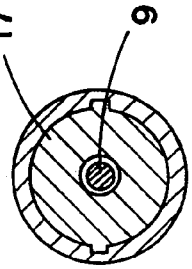
FIG. 7 is a cross-section view taken along the plane VII—VII of FIG. 5.

The additional cylinder 17 is not screwed on the threaded shaft 9, but the latter passes freely through an axial hole of suitable diameter made in the cylinder 17 (see also FIG. 7).

Therefore, the rotation of the shaft 9 due to the rotation of the roller 1 during the curtain 2 rolling up and unrolling, determines only the translation of the cylinder 11, as described previously.

The additional cylinder 17, on which the spring 18 acts, determines a friction effect of constant value, adjustable in pre-loading step by the nut 19.

Figure 8:
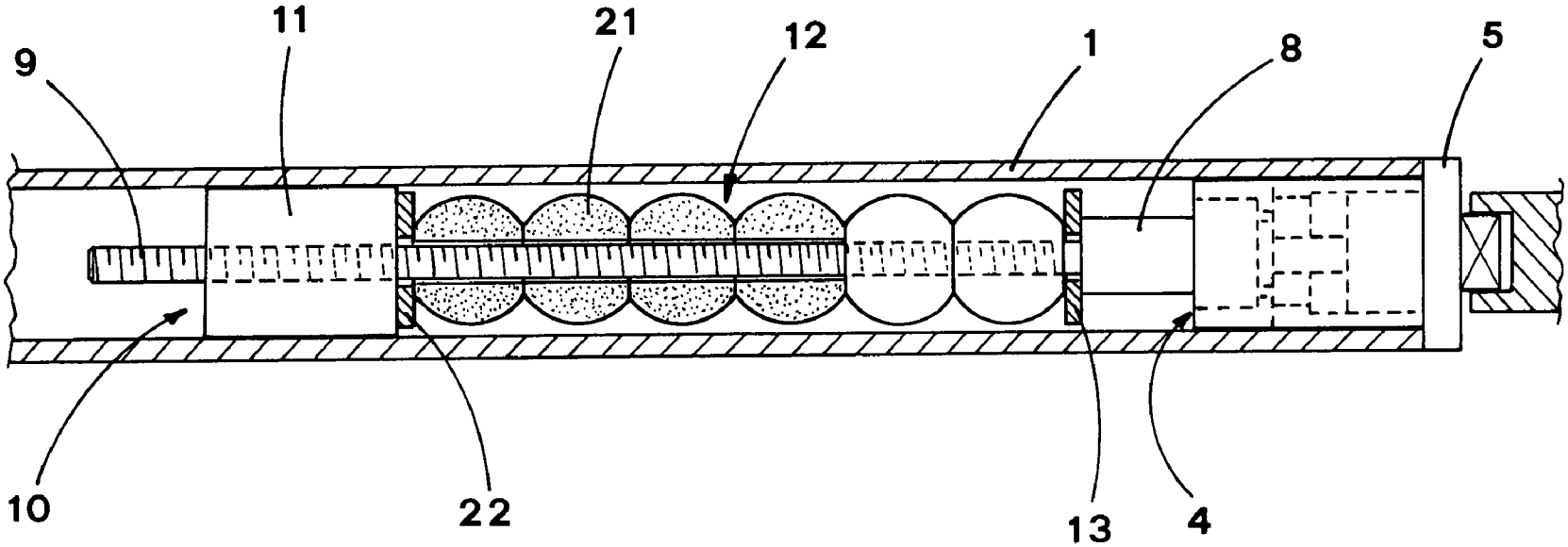
FIGS. 8 and 9 are longitudinal section views of another embodiment of the head of the roller, in different operation steps.
Figure 9:
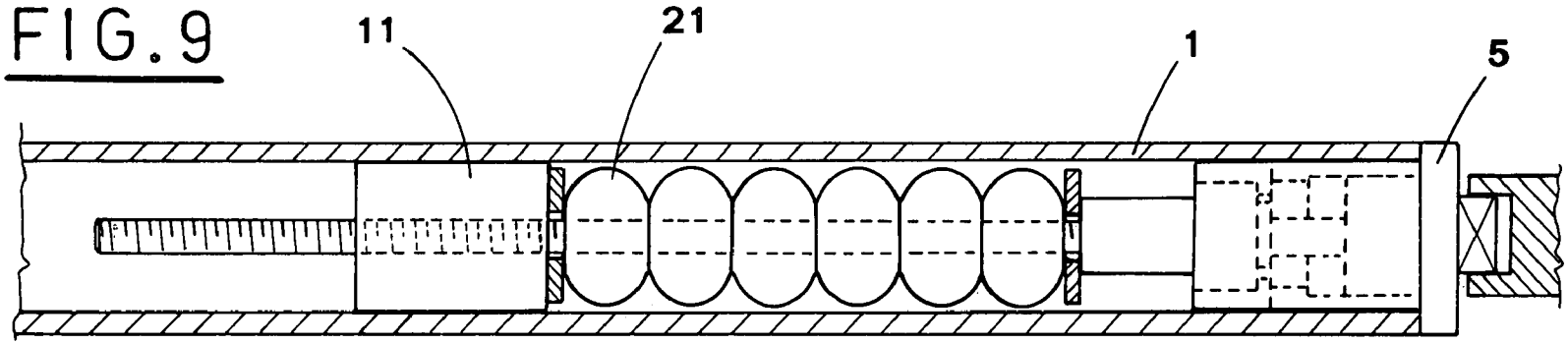

FIGS. 8 and 9 show another embodiment of the friction device 10, in which the elastic member 12 is advantageously formed by a plurality of balls 21, made of elastic material, e.g. neoprene rubber or another elastic material.

The balls 21, suitably bored along a diametric axis, are put on the shaft 9 of the friction device, close to each other.

The balls 21 of elastic material are clamped between a pair of abutment disks 22, 13, which are supported respectively by the cylinder 11 and by the planetary wheel carrying member 8 connected to the reducer connection group 4: also in this case the elastic means, i.e. the balls 21, are subjected to pressure or counter-thrust.

In rest position, i.e. when the curtain 2 is rolled up, the balls 21 are not compressed and consequently do not perform braking action (FIG. 8).

On the contrary, during the unrolling of the curtain 2, the balls 21 are progressively compressed due to the axial translation of the cylinder 11, as seen in FIG. 9.

Obviously, the compression of the balls 21 increases progressively the elastic thrust performed on the cylinder 11 and consequently also the friction effect performed between the contacting surfaces.

Obviously, the number of the balls 21 can suitably vary in relation to the dimensions of the roll-up curtain.

The balls 21 can also have different elastic reaction characteristics, due to e.g. different hardness of the elastic material of which they are made. Also, balls with different diameters can be used. Balls 21 with different elastic reaction characteristics can be also included in a definite series of balls 21.

For instance, the braking effect of the friction device can be correspondingly changed by substituting one or more balls 21 of the series with others of different characteristics and/or different diameters.

In practical terms, it allows to meet a wide range of needs.

Figure 10:
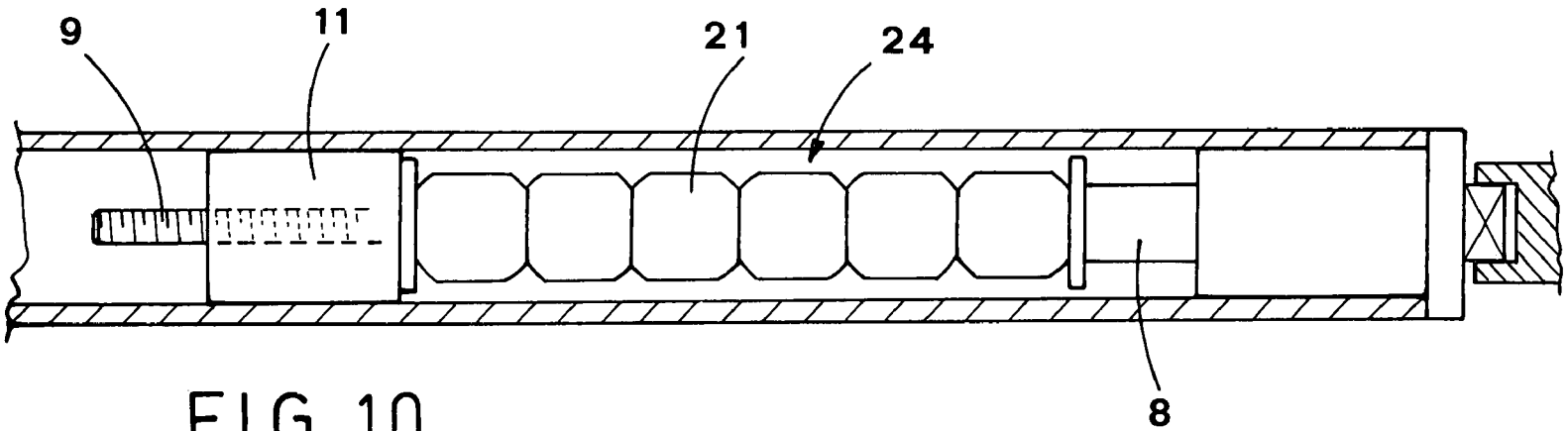
FIG. 10 is the same longitudinal section view of a variant of the head of the roller.

The balls 21 of elastic material can have a flattened outline 24, which avoids any interference with the inner surface of the roller 1 while being compressed (see FIG. 10).

The proposed device which uses the balls 21 is particularly designed for economic curtains.

Consequently, the proposed friction device fulfills the object to avoid the fall of the roll-up curtain during the unrolling step, even if the curtain is relatively heavy.

A prerogative of the proposed friction device derives from the fact that it performs an increasing braking action during the curtain unrolling, so as to contrast efficiently the corresponding increase of the curtain descent speed and, consequently creates substantially uniform operation conditions.

It is also to be pointed out that the friction device can be advantageously used with roll-up curtains equipped with return elastic means, as well as with roll-up curtains operated manually, so that its use is universal.

In case of curtains operated by chain, the proposed device is not damaged if the operator acts manually on the curtains.

The particular conformation of the proposed solution makes the corresponding device universal, i.e. valid for curtains with operating chain situated on the left as well as on the right.

What is claimed is:

1. A friction device for roll-up curtains comprising a tubular roller (1) on which a curtain (2) rolls up, a threaded shaft located along a horizontal axis of the tubular roller which is rotatably carried on the horizontal axis, the threaded shaft (9) situated axially inside said roller (1) and connected to the roller (1) by interposition of an angular speed reducer group (4); a body (11) mounted slidingly and axially inside said roller (1) and screw-coupled with said threaded shaft (9), so as to translate axially due to the rotation of shaft (9) during unrolling or rolling up of said curtain (2) on said roller (1); at least one elastic member (12) which is tightened on opposite ends thereof, between abutment means (13) and a surface disposed on said shaft (9), to determine, due to the pressure or counter-thrust to which the elastic member is subjected, a friction effect, which varies as a function of the rotation direction of said roller (1), said elastic member (12) including a plurality of balls (21) of elastic material, bored along a diametric axis, and set on said shaft (9) close to each other.

2. The friction device according to claim 1, wherein said elastic material is selected from the group consisting of neoprene type rubber, synthetic elastic material, or natural elastic material.

3. The friction device, according to claim 1, wherein said balls have different diameters.

4. The friction device, according to claim 3, wherein said balls have different elastic reaction characteristics, being produced with elastic materials having different hardness.

5. The friction device, according to claim 1, wherein said balls (21) have differentiated compression characteristics, being produced with elastic materials having different hardness.

6. The friction device, according to claim 5, wherein said balls have different diameters.

7. The friction device, according to claim 1, wherein said balls (21) have a flattened peripheral outline (24) to avoid interference with an inner surface of said tubular roller (1).

8. The friction device, according to claim 7, wherein said balls have different diameters.

9. The friction device, according to claim 8, wherein said balls have different elastic reaction characteristics, being produced with elastic materials having different hardness.

10. The fiction device according to claim 1 wherein said angular speed reducer group (4) drives said shaft (9) into rotation with angular displacements reduced with respect to said roller (1) during curtain unrolling.

11. The friction device according to claim 1 wherein said body (11) includes a cylinder equipped with means for prismatic coupling with said roller (1).

12. The friction device according to claim 11 wherein said prismatic coupling means includes a pair of teeth (14) made in diametrically opposite positions on said cylinder (11) and guided in corresponding inner grooves of said roller (1).

13. The friction device according to claim 1 wherein said abutment means includes a nut adjustably positioned on said threaded shaft (9).

14. The friction device according to claim 1 further comprising an additional body (17) which goes in abutment against said abutment means (13), stressed by a second elastic member (18), which in turn goes in abutment against a further abutment means (19).

15. The friction device according to claim 14 wherein said shaft (9) passes freely through said additional body (17).

* * * * *